US009107265B2

(12) United States Patent
Lin et al.

(10) Patent No.: US 9,107,265 B2
(45) Date of Patent: Aug. 11, 2015

(54) LIGHT EMITTING DEVICE ARRAY BILLBOARD AND CONTROL METHOD THEREOF

(71) Applicants: Shui-Mu Lin, Taichung (TW); Chien-Hua Lin, Changhua (TW); Ching-Yu Chen, Hsinchu (TW); Chin-Hui Wang, New Taipei (TW); Yung-Chun Chuang, Taipei (TW); Ti-Ti Liu, Taipei (TW)

(72) Inventors: Shui-Mu Lin, Taichung (TW); Chien-Hua Lin, Changhua (TW); Ching-Yu Chen, Hsinchu (TW); Chin-Hui Wang, New Taipei (TW); Yung-Chun Chuang, Taipei (TW); Ti-Ti Liu, Taipei (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 14/539,082

(22) Filed: Nov. 12, 2014

(65) Prior Publication Data

US 2015/0156829 A1 Jun. 4, 2015

Related U.S. Application Data

(60) Provisional application No. 61/910,745, filed on Dec. 2, 2013.

(51) Int. Cl.
*H05B 37/02* (2006.01)
*H05B 33/08* (2006.01)

(52) U.S. Cl.
CPC ..... *H05B 33/083* (2013.01); *H05B 33/0827* (2013.01)

(58) Field of Classification Search
CPC ..... H05B 37/02; H05B 33/08
USPC ..... 315/192, 210; 345/46, 81, 82, 92
See application file for complete search history.

(56) References Cited

U.S. PATENT DOCUMENTS

| | | | | |
|---|---|---|---|---|
| 9,013,376 | B2 * | 4/2015 | Nozawa | 345/76 |
| 2008/0074412 | A1 * | 3/2008 | Nozawa | 345/212 |
| 2013/0099682 | A1 * | 4/2013 | Williams et al. | 315/185 R |
| 2013/0154498 | A1 * | 6/2013 | Missbach | 315/210 |

* cited by examiner

*Primary Examiner* — Daniel D Chang
(74) *Attorney, Agent, or Firm* — Tung & Associates

(57) ABSTRACT

The present invention discloses a light emitting device array billboard and a control method thereof. The light emitting device array billboard includes a light emitting device array circuit, plural line switch circuits, plural channel switch circuits, plural ghost image compensation switch circuits, and a control circuit. The control circuit operates the line switch circuits and the channel switch circuit to turn ON a selected light emitting device for a duty period in a lighting period, and operates the plural ghost image compensation switch circuits to electrically connect a channel node corresponding to the selected light emitting device to a ghost image compensation voltage after the lighting period. The control circuit further adjusts a channel operation signal according to a gray scale compensation signal, to turn ON the selected light emitting device for a gray scale compensation period in addition to the duty period.

10 Claims, 12 Drawing Sheets

LIGHT EMITTING DEVICE ARRAY BILLBOARD AND CONTROL METHOD THEREOF

CROSS REFERENCE

The present invention claims priority to U.S. 61/910,745, filed on Dec. 2, 2013.

BACKGROUND OF THE INVENTION

1. Field of Invention

The present invention relates to a light emitting device array billboard and a control method thereof; particularly, it relates to such a light emitting device array billboard which can avoid ghost images and with low gray scale compensation, and a control method thereof.

2. Description of Related Art

FIG. 1A shows a schematic circuit diagram of a conventional light emitting diode (LED) array billboard 100. As shown in FIG. 1A, the LED array billboard 100 includes an LED array 110, plural line switch circuits 120, and plural channel switch circuits 130. The LED array 110 includes plural LEDs (LED1A~LED4D), arranged by lines (line N−1~line N+2) and channels (CH1~CH4). The LED array billboard 100 operates by scanning line by line. In one frame, the LED array billboard 100 supplies a conduction voltage VDD to each line sequentially, and stops supplying the conduction voltage VDD before the next line is turned ON; on the other hand, the LED array billboard 100 electrically connects one or more selected channels to corresponding current sources at a proper timing, such that selected LEDs in the LED array 110 is turned ON, and thereby the LED array billboard 100 shows a desired pattern. For example, As shown in FIG. 1A, to turn ON the LED LED3B at line N and channel CH3, a line operation signal controls the line switch circuit 120 of the line N (referring to FIG. 1B) such that the switch S1 is ON and the switch S2 is OFF, to electrically connect the node NLN of the line N to the conduction voltage VDD; at the same time, a channel operation signal controls the channel switch circuit 130 of the channel CH3 (referring to FIG. 1C) such that the switch S3 is ON to electrically connect the node NC3 of the channel CH3 to the current source CS3 of the channel, whereby an LED current flows through the LED LED3B at line N and channel CH3 to turn ON the LED LED3B.

The LED array billboard 100 has a problem of "ghost image", including upper and lower ghost image. Referring to FIG. 1D, a typical test is to sequentially turn ON the LEDs at a diagonal line (shown by the white circles) of the LED array 110 (shown by an array of circles), to check whether the LED array billboard 100 can operate normally. During this test, it is often found that the LEDs (shown by the gray circles) above the diagonal line weakly emit light. This phenomenon is called "the upper ghost image". The reason to cause the upper ghost image is due to the parasitic capacitor CR in the line switch circuits 120. Referring to FIG. 1A, in the above-mentioned test, the line operation signal controls the line switch circuits 120 to sequentially electrically connect the node NLN−1 of the line N−1 and the node NLN of the line N to the conduction voltage VDD. Correspondingly, the channel operation signal controls the channel switch circuits 130 to sequentially electrically connect the node NC4 of the channel CH4 to the current source CS4 and the node NC3 of the channel CH3 to the current source CS3. The LED LED4A at line N−1 and channel CH4, and the LED LED3B at line N and channel CH3, are sequentially turned ON. However, after the node NLN−1 is disconnected from the conduction voltage VDD, there are charges still remaining in the parasitic capacitor CR of the line switch circuit 120, such that when the channel switch circuit 130 of the channel CH3 electrically connects the node NC3 to the current source CS3, the charges remaining in the parasitic capacitor CR in the line switch circuit 120 of the line N−1 discharge through the LED LED3A to the node NC3, and through the current source CS3 of the channel CH3 to ground. For this reason, the LED LED3A at line N−1 and channel CH3 is weakly turned ON to cause the upper ghost image as shown in FIG. 1D by the dashed circle.

Referring to FIGS. 2A and 2B, during the above-mentioned test, it is also often found that the LEDs (shown by the gray circles) below the diagonal line weakly emit light. This phenomenon is called "the lower ghost image". The reason to cause the lower ghost image is due to the parasitic capacitor CC in the channel switch circuits 130. In the above-mentioned test, the line operation signal controls the line switch circuits 120 to sequentially electrically connect the node NLN of the line N and the node NLN+1 of the line N+1 to the conduction voltage VDD. Correspondingly, the channel operation signal controls the channel switch circuits 130 to sequentially electrically connect the node NC3 of the channel CH3 to the current source CS3 and the node NC2 of the channel CH2 to the current source CS2. The LED LED3B at line N and channel CH3, and the LED LED2C at line N+1 and channel CH2, are sequentially turned ON. However, after the channel switch circuit 130 of the channel CH3 stops electrically connecting the node NC3 to the current source CS3, because of the parasitic capacitor CC in the channel switch circuit 130, when the line operation signal electrically connects the node NLN+1 of the line N+1 to the conduction voltage VDD, a charging path is formed from the line switch circuits 120 through the node NLN+1 and the LED LED3C to the parasitic capacitor CC in the channel switch circuit 130, and during the charging process, the reverse end of the LED LED3C is not high enough to cause the LED LED3C non-conductive, so the voltage difference across the LED LED3C still turns ON the LED LED3C to cause the lower ghost image as shown in FIG. 2B by the dashed circle.

To explain the lower ghost image problem in more detail, please refer to FIGS. 2C-2G, which show the operations of the switches S1-S2 in the line switch circuits 120 of the lines N and N+1 and the switch S3 in the channel switch circuits 130 of the channels CH2 and CH3 when the LED LED3B and the LED LED2C are sequentially turned ON. FIG. 2H shows signal waveforms in the process from FIG. 2C to FIG. 2G.

Referring to FIG. 2C, first at stage A, the switch S1 in the line switch circuit 120 of the line N is ON and the switch S2 in the line switch circuit 120 of the line N is OFF, while the switch S1 in the line switch circuit 120 of the line N+1 is OFF and the switch S2 in the line switch circuit 120 of the line N is ON. The switch S3 in the channel switch circuit 130 of the channel CH3 is ON and the switch S3 in the channel switch circuit 130 of the channel CH2 is OFF. Therefore, as shown in FIG. 2H, at stage A, the voltage VN of the node NLN maintains at the conduction voltage VDD; the voltage VN+1 of the node NLN+1 maintains at 0V; the voltage VCH3 of the node NC3 maintains at a voltage which is equal to the conduction voltage VDD minus the forward bias voltage VDON of an LED; the voltage VCH2 of the node NC2 maintains at a non-conductive voltage VDOFF which is higher than the conduction voltage VDD minus the forward bias voltage VDON of an LED; the current ILED3B flowing through the LED LED3B is the current ILED controlled by the current source CS3; the current ILED2C flowing through the LED LED2C maintains at 0 A; and the current ILED3C flowing through the LED LED3C also maintains at 0 A.

Referring to FIG. 2D, at stage B, the switch S1 in the line switch circuit 120 of the line N is ON and the switch S2 in the line switch circuit 120 of the line N is OFF, while the switch S1 in the line switch circuit 120 of the line N+1 is OFF and the switch S2 in the line switch circuit 120 of the line N is ON. The switch S3 in the channel switch circuit 130 of the channel CH3 is turned OFF and the switch S3 in the channel switch circuit 130 of the channel CH2 is OFF. Therefore, as shown in FIG. 2H, at stage B, the voltage VN of the node NLN maintains at the conduction voltage VDD; the voltage VN+1 of the node NLN+1 maintains at 0V; the voltage VCH3 of the node NC3 increases from the voltage which is equal to the conduction voltage VDD minus the forward bias voltage VDON of an LED, and charges the parasitic capacitor CC; the voltage VCH2 of the node NC2 maintains at a non-conductive voltage VDOFF which is higher than the conduction voltage VDD minus the forward bias voltage VDON of an LED; the current ILED3B flowing through the LED LED3B becomes 0 A; the current ILED2C flowing through the LED LED2C maintains at 0 A; and the current ILED3C flowing through the LED LED3C also maintains at 0 A.

Referring to FIG. 2E, at stage C, the switch S1 in the line switch circuit 120 of the line N is turned OFF and the switch S2 in the line switch circuit 120 of the line N is turned ON, while the switch S1 in the line switch circuit 120 of the line N+1 is OFF and the switch S2 in the line switch circuit 120 of the line N is ON. The switch S3 in the channel switch circuit 130 of the channel CH3 is OFF and the switch S3 in the channel switch circuit 130 of the channel CH2 is OFF. Therefore, as shown in FIG. 2H, at stage C, the voltage VN of the node NLN becomes 0V; the voltage VN+1 of the node NLN+1 maintains at 0V; the voltage VCH3 of the node NC3 keeps increasing from the voltage which is equal to the conduction voltage VDD minus the forward bias voltage VDON of an LED, and continues charging the parasitic capacitor CC; the voltage VCH2 of the node NC2 maintains at a non-conductive voltage VDOFF which is higher than the conduction voltage VDD minus the forward bias voltage VDON of an LED; the current ILED3B flowing through the LED LED3B maintains at 0 A; the current ILED2C flowing through the LED LED2C maintains at 0 A; and the current ILED3C flowing through the LED LED3C also maintains at 0 A.

Referring to FIG. 2F, at stage D, the switch S1 in the line switch circuit 120 of the line N is OFF and the switch S2 in the line switch circuit 120 of the line N is ON, while the switch S1 in the line switch circuit 120 of the line N+1 is turned ON and the switch S2 in the line switch circuit 120 of the line N is turned OFF. The switch S3 in the channel switch circuit 130 of the channel CH3 is OFF and the switch S3 in the channel switch circuit 130 of the channel CH2 is OFF. Therefore, as shown in FIG. 2H, at stage D, the voltage VN of the node NLN maintains at 0V; the voltage VN+1 of the node NLN+1 changes from 0V to the conduction voltage VDD; the voltage VCH3 of the node NC3 keeps increasing from the voltage which is equal to the conduction voltage VDD minus the forward bias voltage VDON of an LED, and continues charging the parasitic capacitor CC; the voltage VCH2 of the node NC2 maintains at a non-conductive voltage VDOFF which is higher than the conduction voltage VDD minus the forward bias voltage VDON of an LED; the current ILED3B flowing through the LED LED3B maintains at 0 A; the current ILED2C flowing through the LED LED2C maintains at 0 A; however, the current ILED3C flowing through the LED LED3C is not zero current due to the lower ghost image problem. The voltage VN+1 is the conduction voltage VDD, but the voltage VCH3 has not yet reached a level sufficient to render the LED LED3C non-conductive. Hence, the LED LED3C is weakly turned ON to cause the lower ghost image.

Referring to FIG. 2G, at stage E, the switch S1 in the line switch circuit 120 of the line N is OFF and the switch S2 in the line switch circuit 120 of the line N is ON, while the switch S1 in the line switch circuit 120 of the line N+1 is ON and the switch S2 in the line switch circuit 120 of the line N is OFF. The switch S3 in the channel switch circuit 130 of the channel CH3 is OFF and the switch S3 in the channel switch circuit 130 of the channel CH2 is turned ON. Therefore, as shown in FIG. 2H, at stage E, the voltage VN of the node NLN maintains at 0V; the voltage VN+1 of the node NLN+1 maintains at the conduction voltage VDD; the voltage VCH3 of the node NC3 keeps increasing from the voltage which is equal to the conduction voltage VDD minus the forward bias voltage VDON of an LED, to the non-conductive level VDOFF; the voltage VCH2 of the node NC2 changes from the non-conductive voltage VDOFF to the voltage which is equal to the conduction voltage VDD minus the forward bias voltage VDON of an LED; the current ILED3B flowing through the LED LED3B maintains at 0 A; the current ILED2C flowing through the LED LED2C is the current ILED controlled by the current source CS2; the current ILED3C flowing through the LED LED3C becomes zero current because the voltage VCH3 has reached a level sufficient to render the LED LED3C non-conductive.

In view of the above drawback of the prior art, the present invention provides a light emitting device array billboard which can avoid ghost images and with low gray scale compensation, and a control method thereof.

SUMMARY OF THE INVENTION

In one perspective, the present invention provides a light emitting device array billboard, comprising: a light emitting device array including a plurality of light emitting devices arranged by a plurality of lines and a plurality of channels, wherein in each line, a forward end of each light emitting device is coupled to a common line node, and in each channel, a reverse end of each light emitting device is coupled to a common channel node; a plurality of line switch circuits respectively coupled to the corresponding line nodes, for electrically connecting the corresponding line nodes to a conduction voltage or a discharge path according to a line operation signal; a plurality of channel switch circuits each of which includes a corresponding current source, the channel switch circuits being respectively coupled to the corresponding channel nodes, for electrically connecting selected ones of the channel nodes to corresponding current sources according to a channel operation signal; a plurality of ghost image compensation switch circuits respectively coupled to the corresponding channel nodes, for electrically connecting selected ones of the channel nodes to a ghost image compensation voltage according to a ghost image compensation signal; and a control circuit coupled to the line switch circuits, the channel switch circuits and the ghost image compensation switch circuits, for providing the line operation signal, the channel operation signal and the ghost image compensation signal; wherein the control circuit provides the line operation signal and the channel operation signal to respectively control the line switch circuits and the channel switch circuits such that a selected one of the light emitting devices is turned ON for a duty period within a lighting period, and the control circuit provides the ghost image compensation signal to control the ghost image compensation switch circuits such that the channel node corresponding to the selected one of the light emitting devices is electrically connected to the ghost image compensation voltage when the selected one of the light emitting devices is not conductive after the lighting period; and wherein the control circuit further adjusts the channel operation signal according to a gray scale compensation signal such that the selected one of the light emitting devices is turned ON for a gray scale compensation period in addition to the duty period.

In one embodiment, each of the line switch circuits includes: a first switch coupled to the corresponding line node, for electrically connecting the corresponding line node to the conduction voltage according to the line operation signal; and a second switch coupled to the corresponding line node, for electrically connecting the corresponding line node to ground or a relatively lower potential according to the line operation signal, for providing the discharge path.

In one embodiment, each of the channel switch circuits includes: a third switch coupled to the corresponding channel node, for electrically connecting the corresponding channel node to the current source according to the channel operation signal; and the current source, coupled to the third switch, for providing a light emitting device current to the selected one of the light emitting devices.

In one embodiment, the control circuit further provides an adjustment signal according to the gray scale compensation signal to adjust the light emitting device current in the gray scale compensation period.

In one embodiment, the ghost image compensation voltage is higher than a voltage which is equal to the conduction voltage minus a forward bias voltage of the light emitting device.

In one embodiment, the control circuit further adjusts the channel operation signal according to the gray scale compensation signal such that the non-selected light emitting devices are not turned ON in the lighting period and the gray scale compensation period.

In another perspective, the present invention provides a method for controlling a light emitting device array billboard which includes a plurality of light emitting devices arranged by a plurality of lines and a plurality of channels, wherein in each line, a forward end of each light emitting device is coupled to a common line node, and in each channel, a reverse end of each light emitting device is coupled to a common channel node, the method comprising: selecting at least one of the light emitting devices; electrically connecting the line node corresponding to the selected one of the light emitting devices to a conduction voltage or a discharge path according to a line operation signal; electrically connecting the channel node corresponding to the selected one of the light emitting devices to a current source according to a channel operation signal; electrically connecting the channel node corresponding to the selected one of the light emitting devices to a ghost image compensation voltage according to a ghost image compensation signal, whereby the selected one of the light emitting devices is turned ON for a duty period within a lighting period according to the line operation signal and the channel operation signal, and the channel node corresponding to the selected one of the light emitting devices is electrically connected to the ghost image compensation voltage according to the ghost image compensation signal after the lighting period; and adjusting the channel operation signal according to a gray scale compensation signal such that the selected one of the light emitting devices is turned ON for a gray scale compensation period in addition to the duty period.

The objectives, technical details, features, and effects of the present invention will be better understood with regard to the detailed description of the embodiments below, with reference to the attached drawings.

BRIEF DESCRIPTION OF THE DRAWINGS

FIGS. 2C-2G show operations of the switches S1-S2 in the line switch circuits 120 of the lines N and N+1 and the switch S3 in the channel switch circuits 130 of the channels CH2 and CH3 when the LED LED3B and the LED LED2C are sequentially turned ON.

DESCRIPTION OF THE PREFERRED EMBODIMENTS

Figure 1A:
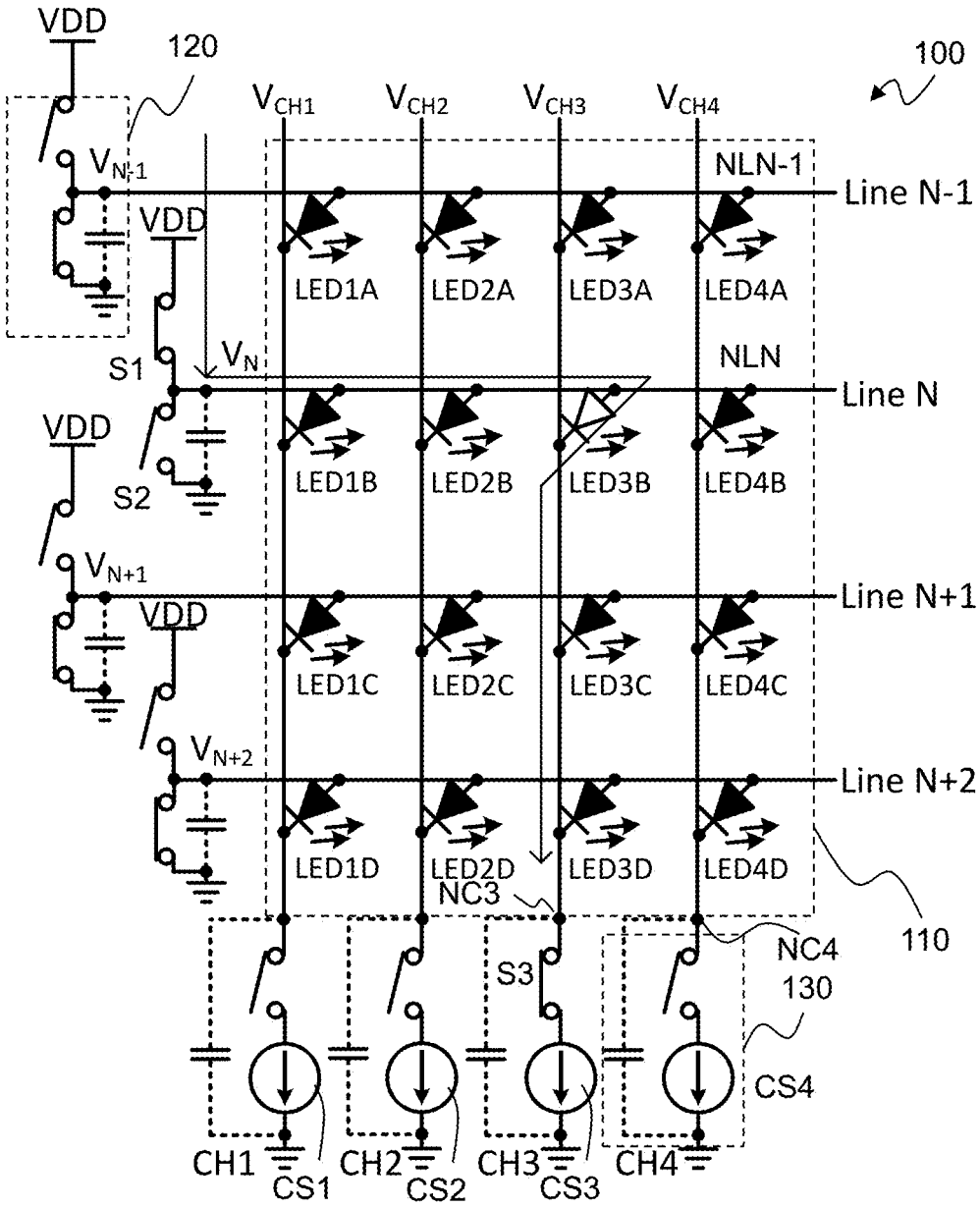
Fig. 1A (Prior Art)
FIG. 1A shows a schematic circuit diagram of a conventional LED array billboard 100.
Figure 1B:
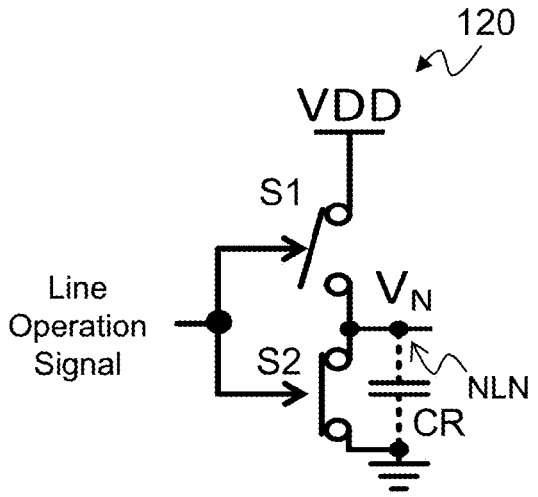
Fig. 1B (Prior Art)
FIGS. 1B and 1C respectively show a line switch circuit 120 and a channel switch circuit 130.
Figure 1C:
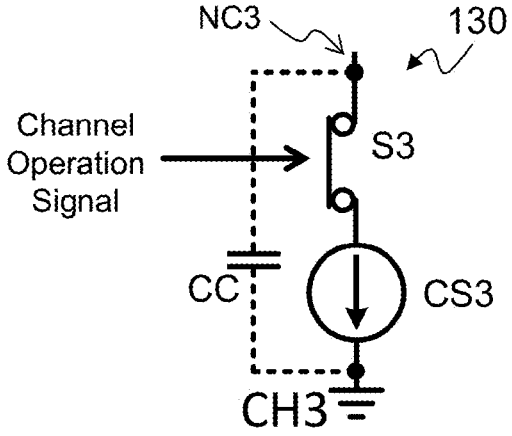
Fig. 1C (Prior Art)
Figure 1D:
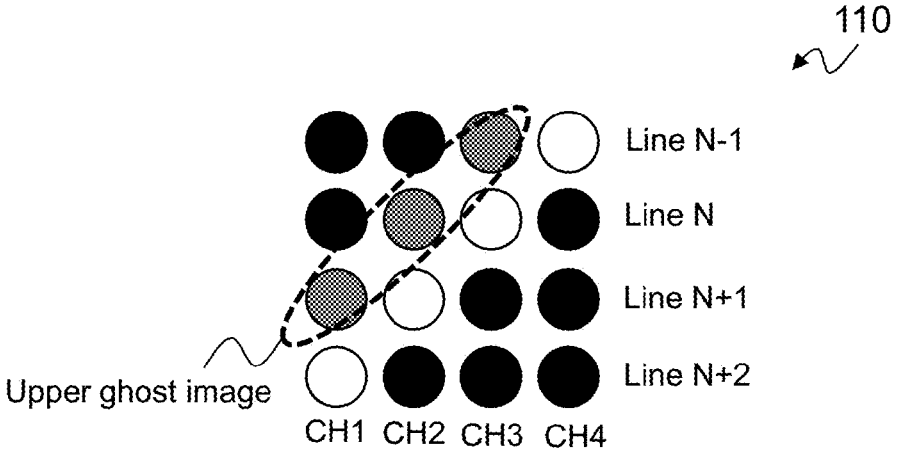
Fig. 1D (Prior Art)
FIG. 1D shows an upper ghost image appearing on the LED array billboard 100.
Figure 2A:
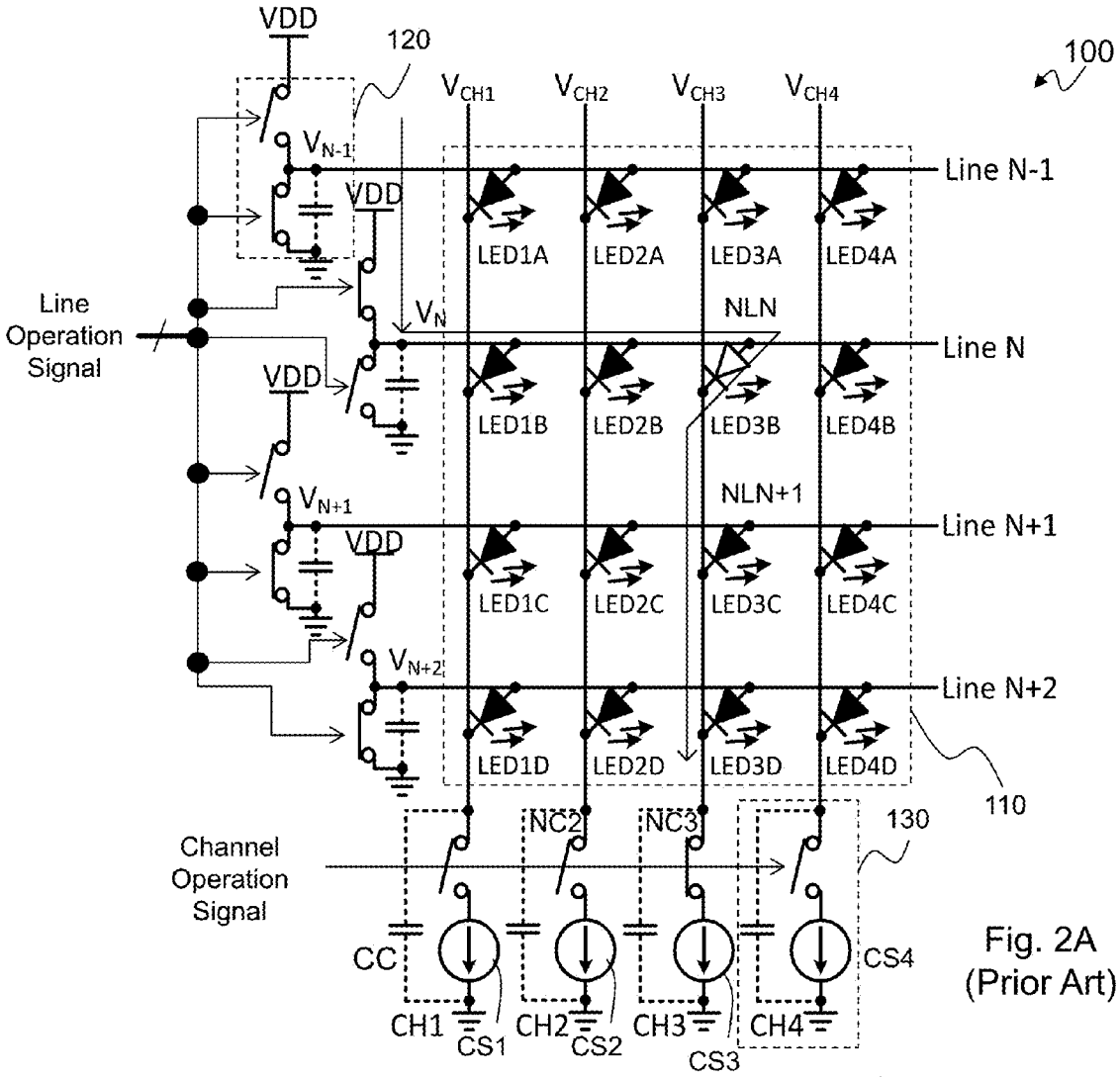
Fig. 2A (Prior Art)
FIGS. 2A and 2B shows a lower ghost image appearing on the LED array billboard 100.
Figure 2B:
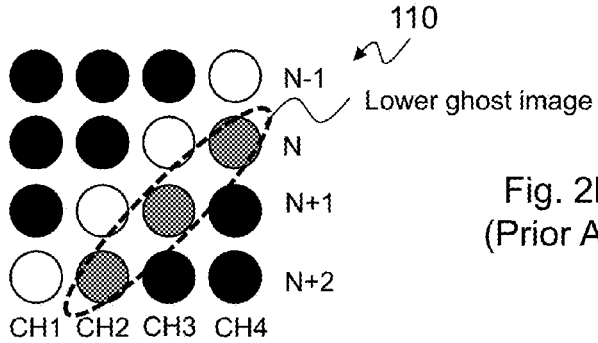
Fig. 2B (Prior Art)
Figure 2C:
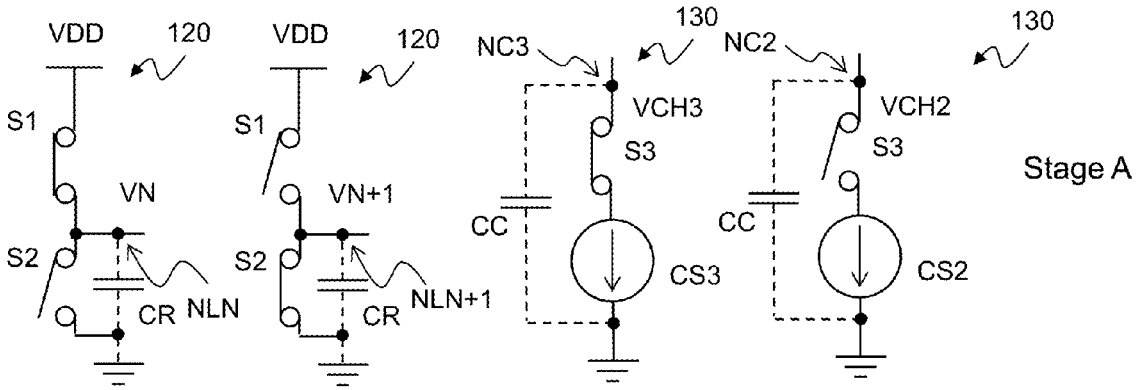
Fig. 2C (Prior Art)
Figure 2D:
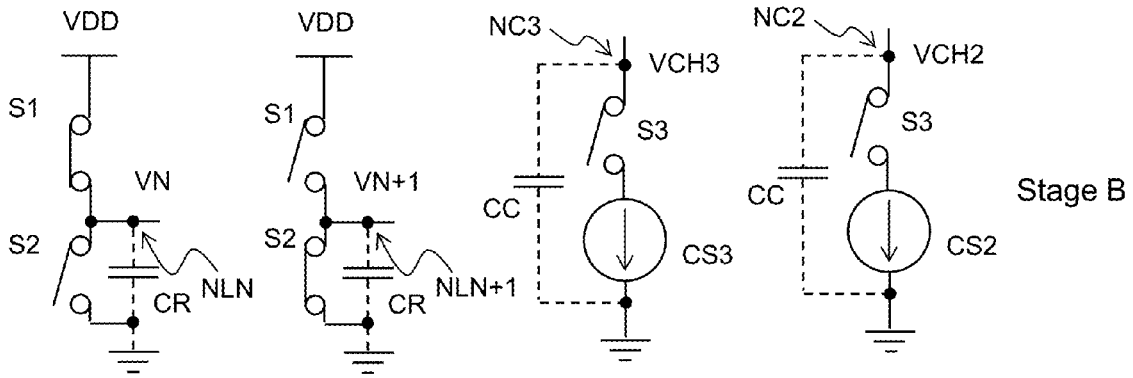
Fig. 2D (Prior Art)
Figure 2E:
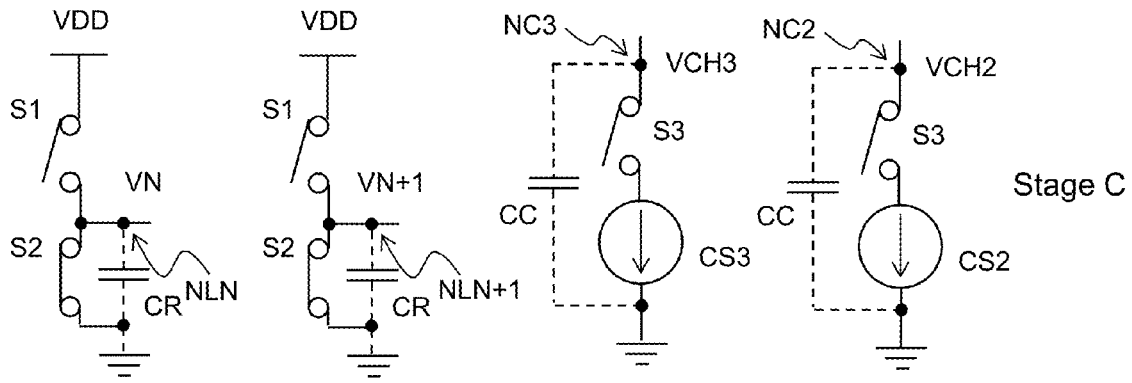
Fig. 2E (Prior Art)
Figure 2F:
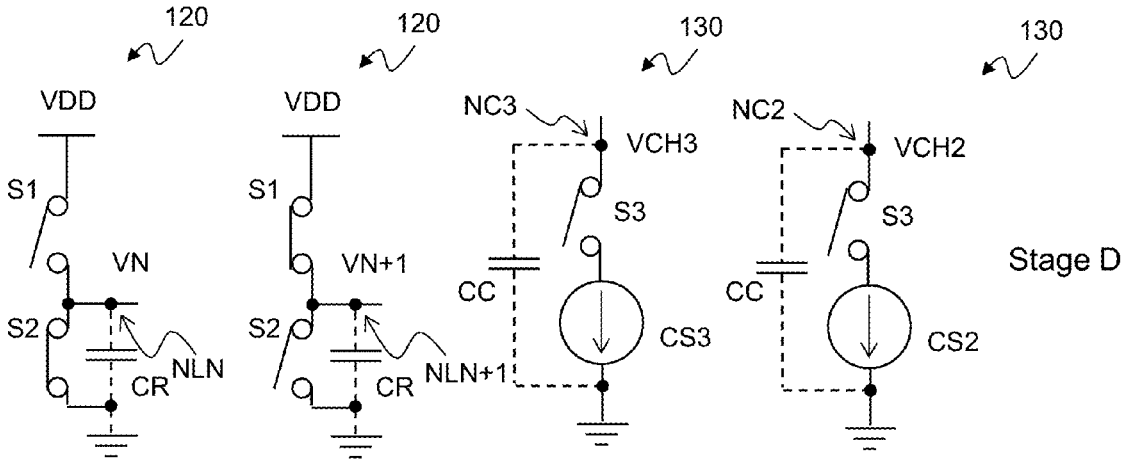
Fig. 2F (Prior Art)
Figure 2G:
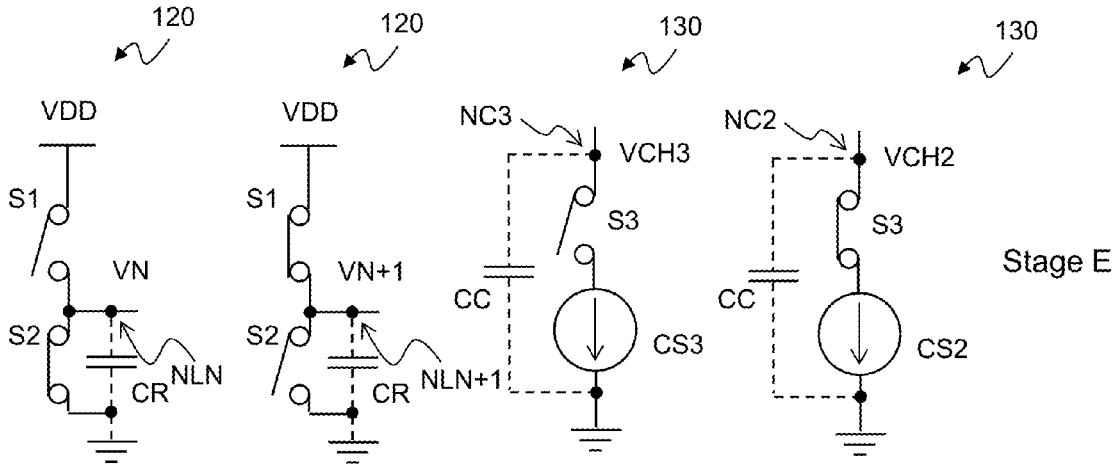
Fig. 2G (Prior Art)
Figure 2H:
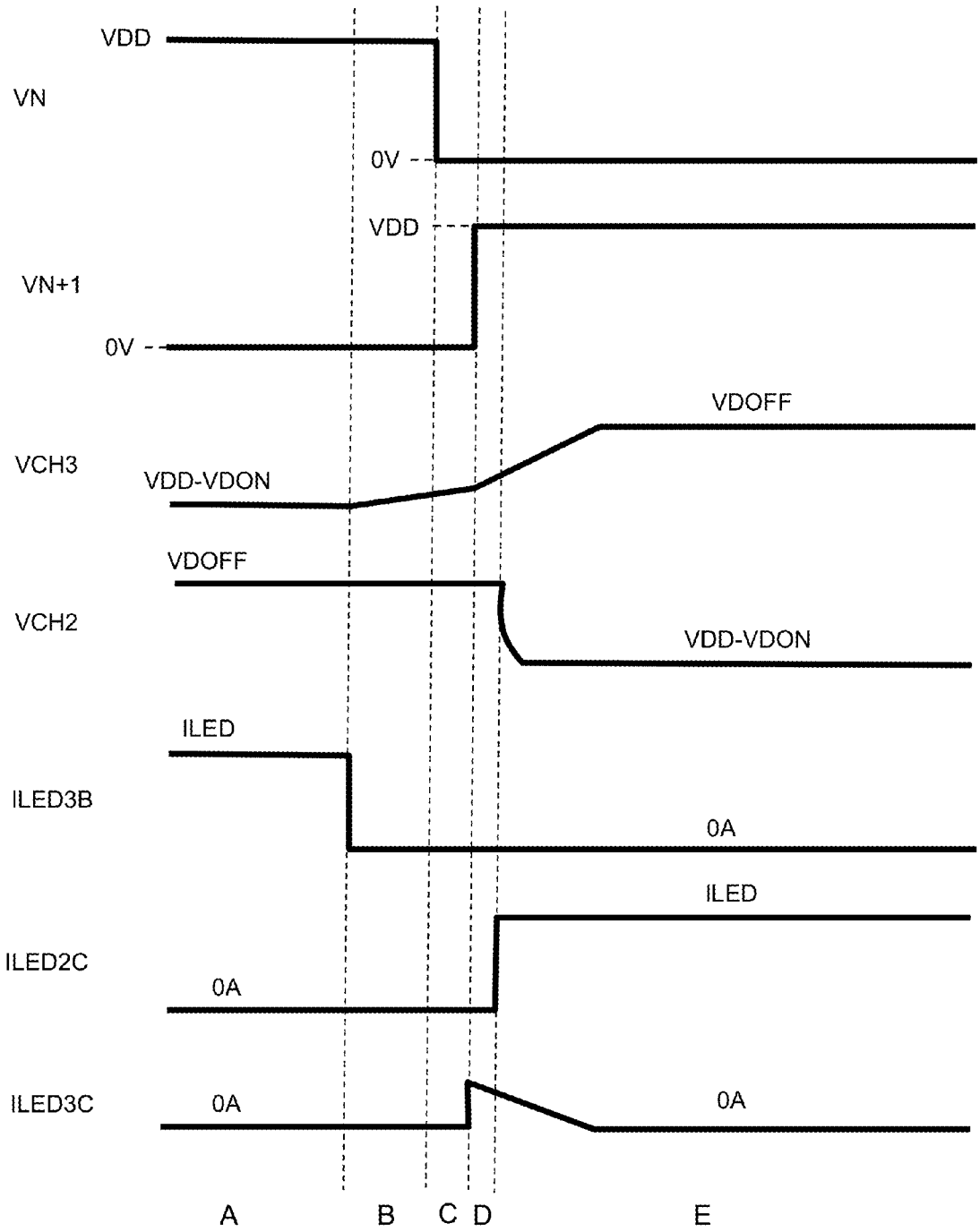
Fig. 2H (Prior Art)
FIG. 2H shows signal waveforms in the process from FIG. 2C to FIG. 2G.
Figure 3A:
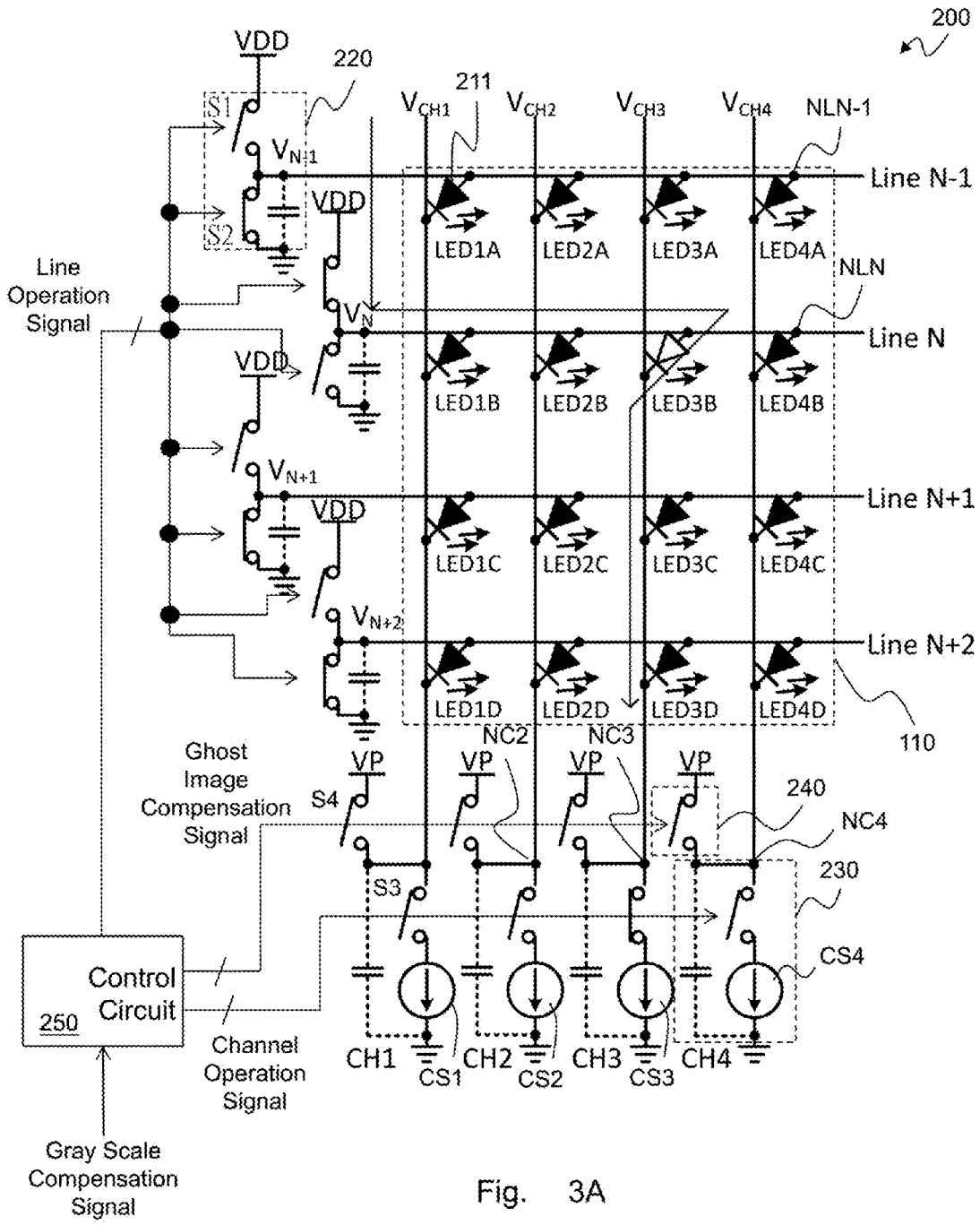
FIGS. 3A-3G show a first embodiment of the present invention.

Please refer to FIGS. 3A-3G, which a first embodiment of the present invention. As shown in FIG. 3A, the LED array billboard 200 includes an LED array 110, plural line switch circuits 220, and plural channel switch circuits 230, plural ghost image compensation switch circuits 240, and a control circuit 250. The LED array 110 includes plural LEDs 211 (for example but not limited to LED1A~LED4D as shown), arranged by lines (line N−1~line N+2) and channels (CH1~CH4). In each line, the forward end of each LED 211 is coupled to a common line node; for example, the LEDs 211 in the line N−1 is coupled to the line node NLN−1, while the LEDs 211 in the line N is coupled to the line node NLN. In each channel, the reverse end of each LED 211 is coupled to a common channel node; for example, the LEDs 211 in the channel CH3 is coupled to the channel node NC3, while the LEDs 211 in the channel CH4 is coupled to the channel node NC4. The plural line switch circuits 220 are coupled to the corresponding line nodes respectively, and the line switch circuits 220 operate according to a line operation signal to electrically connect the corresponding line nodes to a conduction voltage VDD or a discharge path (in one embodiment as shown in the figure, the discharge path is from the line node, through a switch S2 to ground or a relatively lower potential). The conduction voltage VDD is for example but not limited to a typical IC (integrated circuit) operation voltage such as 5V. The discharge path provides a current path for discharging a corresponding line node when the line node is disconnected from the conduction voltage VDD by the line switch circuit 220. The plural channel switch circuits 230 are coupled to the corresponding channel nodes respectively, and the channel switch circuits 230 operate according to a channel operation signal to electrically connect selected channel nodes to corresponding current sources CS1~CS4. The plural ghost image compensation switch circuits 240 are coupled to the corresponding channel nodes respectively, and the ghost image compensation switch circuits 240 operate according to a ghost image compensation signal to electrically connect selected channel nodes to a ghost image compensation voltage VP. The ghost image compensation voltage VP is for example but not limited to a voltage which is high than the conduction voltage VDD minus a forward bias voltage of the LED 211, such that when the ghost image compensation switch circuit 240 provides the ghost image compensation voltage VP to a selected channel node, the LEDs of that selected channel is not conductive, to solve the lower ghost image problem.

The control circuit 250 is coupled to the plural line switch circuits 220, the plural channel switch circuits 230 and the plural ghost image compensation switch circuits 240, for providing the line operation signal, the channel operation signal and the ghost image compensation signal. In one embodiment, the line operation signal sequentially scan the lines (i.e., turn ON the lines one by one sequentially), and the channel operation signal selects one or more channels according to the desired pattern to be shown by the LED array billboard. The control circuit 250 generates the line operation signal and the channel operation signal to respectively control the plural line switch circuits 220 and the plural channel switch circuits 230, such that the selected LEDs 211 of the LED array 110 (such as the LED LED3C shown in FIG. 3A) are turned ON for a duty period DUTY in a lighting period LEP. The control circuit 250 also generates the ghost image compensation signal to control the plural ghost image compensation switch circuits 240, such that the channel nodes (such as the channel node NC3 shown in FIG. 3A) corresponding to the selected LEDs 211 of the LED array 110 are electrically connected to the ghost image compensation voltage VP after the lighting period LEP when the selected LEDs 211 of the LED array 110 are not conductive. In addition, the control circuit 250 further adjusts the channel operation signal according to a gray scale compensation signal, such that the selected LEDs 211 of the LED array 110 (such as the LED LED3C) is further turned ON for a gray scale compensation period LGC in or after the lighting period LEP, to compensate the low gray scale loss generated by the ghost image compensation.

Figure 3B:
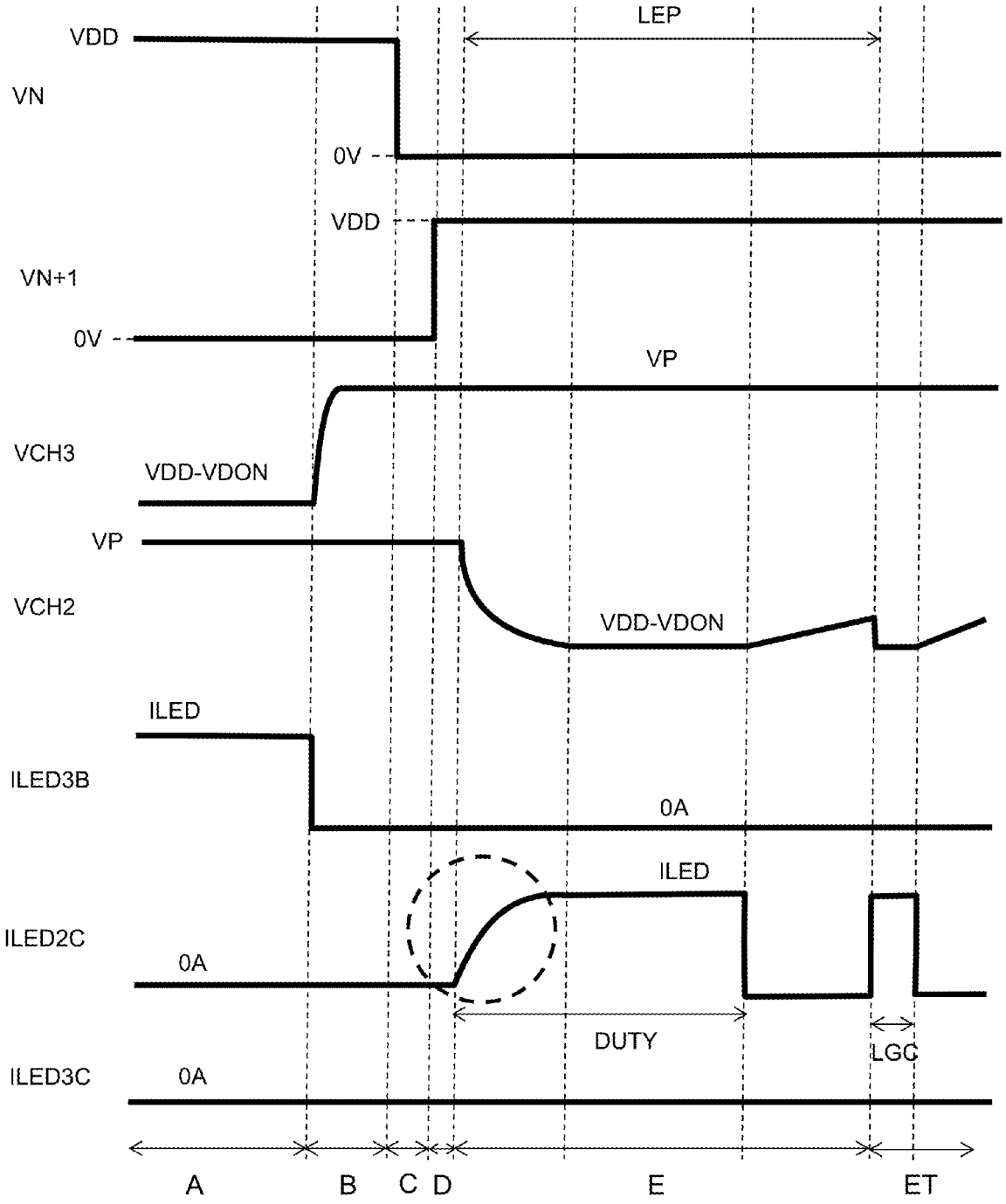

More specifically, please refer to FIGS. 3C-3G, which show the operations of the switches S1-S2 in the line switch circuits 220 of the lines N and N+1, the switch S3 in the channel switch circuits 230 of the channels CH2 and CH3, and the switch S4 in the ghost image compensation switch circuits 240 of the channels CH2 and CH3 when the LED LED3B and the LED LED2C are sequentially turned ON. FIG. 3B shows signal waveforms in the process from FIG. 3C to FIG. 3G.

Figure 3C:
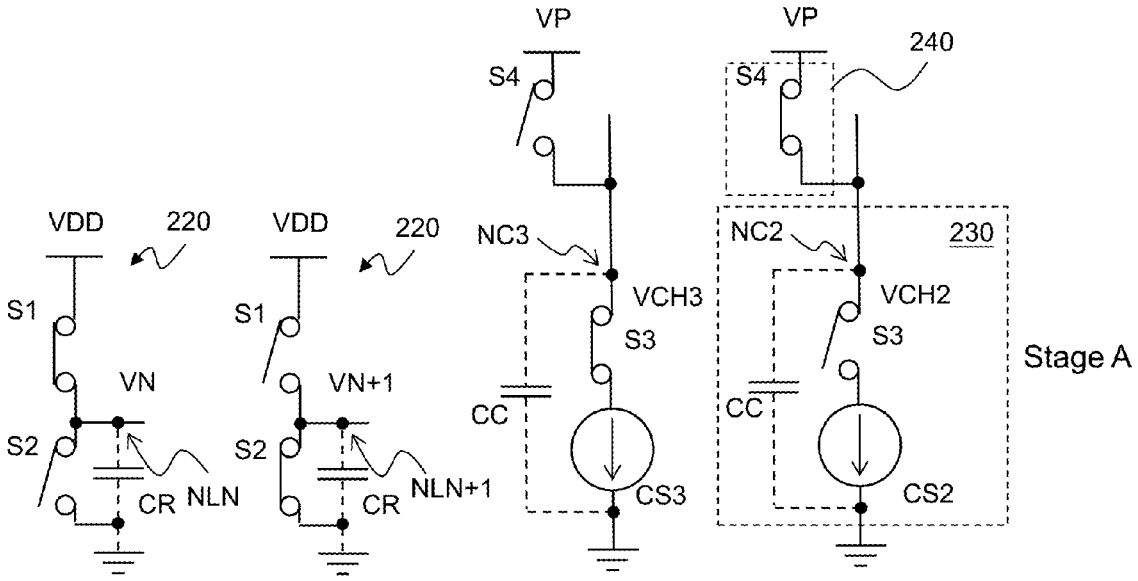

Referring to FIG. 3C, first at stage A, the switch S1 in the line switch circuit 220 of the line N is ON and the switch S2 in the line switch circuit 220 of the line N is OFF, while the switch S1 in the line switch circuit 220 of the line N+1 is OFF and the switch S2 in the line switch circuit 220 of the line N is ON. The switch S3 in the channel switch circuit 230 of the channel CH3 is ON and the switch S3 in the channel switch circuit 230 of the channel CH2 is OFF. The switch S4 in the ghost image compensation switch circuit 240 of the channel CH3 is OFF and the switch S4 in the ghost image compensation switch circuit 240 of the channel CH2 is ON. Therefore, as shown in FIG. 3B, at stage A, the voltage VN of the line node NLN maintains at the conduction voltage VDD; the voltage VN+1 of the line node NLN+1 maintains at 0V; the voltage VCH3 of the channel node NC3 maintains at a voltage which is equal to the conduction voltage VDD minus the forward bias voltage VDON of an LED; the voltage VCH2 of the channel node NC2 is the ghost image compensation voltage VP; the current ILED3B flowing through the LED LED3B is the current ILED controlled by the current source CS3; the current ILED2C flowing through the LED LED2C maintains at 0 A; and the current ILED3C flowing through the LED LED3C also maintains at 0 A. As shown in the figure, the ghost image compensation voltage VP is preferably higher than the conduction voltage VDD minus the forward bias voltage VDON of an LED.

Figure 3D:
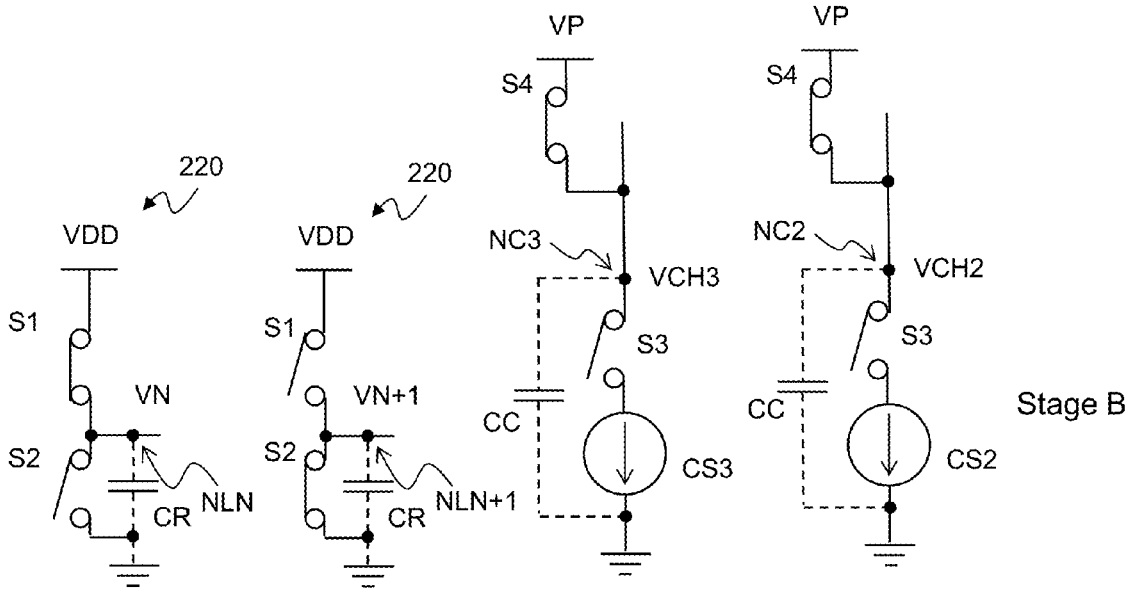

Referring to FIG. 3D, at stage B, the switch S1 in the line switch circuit 220 of the line N is ON and the switch S2 in the line switch circuit 220 of the line N is OFF, while the switch S1 in the line switch circuit 220 of the line N+1 is OFF and the switch S2 in the line switch circuit 220 of the line N is ON. The switch S3 in the channel switch circuit 230 of the channel CH3 is turned OFF and the switch S3 in the channel switch circuit 230 of the channel CH2 is OFF. The switch S4 in the ghost image compensation switch circuit 240 of the channel CH3 is turned ON and the switch S4 in the ghost image compensation switch circuit 240 of the channel CH2 is ON. Therefore, as shown in FIG. 3B, at stage B, the voltage VN of the line node NLN maintains at the conduction voltage VDD; the voltage VN+1 of the line node NLN+1 maintains at 0V; the voltage VCH3 of the channel node NC3 is the ghost image compensation voltage VP instead of a gradually increasing voltage; the voltage VCH2 of the channel node NC2 maintains at the ghost image compensation voltage VP; the current ILED3B flowing through the LED LED3B becomes 0 A; the current ILED2C flowing through the LED LED2C maintains at 0 A; and the current ILED3C flowing through the LED LED3C also maintains at 0 A.

Figure 3E:
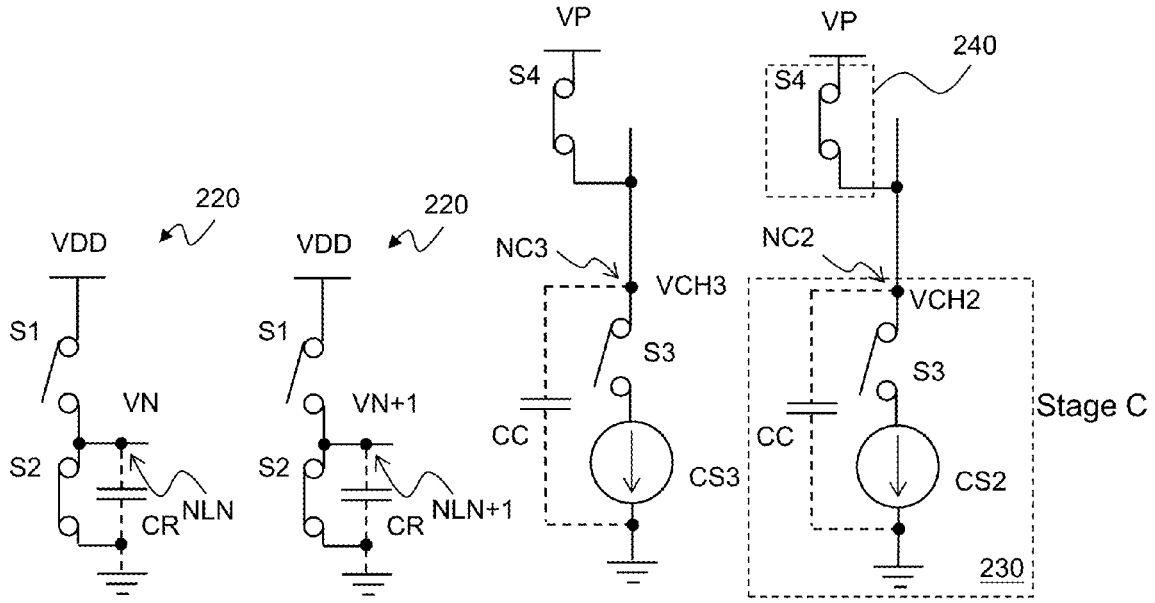

Referring to FIG. 3E, at stage C, the switch S1 in the line switch circuit 220 of the line N is turned OFF and the switch S2 in the line switch circuit 220 of the line N is turned ON, while the switch S1 in the line switch circuit 220 of the line N+1 is OFF and the switch S2 in the line switch circuit 220 of the line N is ON. The switch S3 in the channel switch circuit 230 of the channel CH3 is OFF and the switch S3 in the channel switch circuit 230 of the channel CH2 is OFF. The switch S4 in the ghost image compensation switch circuit 240 of the channel CH3 is ON and the switch S4 in the ghost image compensation switch circuit 240 of the channel CH2 is ON. Therefore, as shown in FIG. 3B, at stage C, the voltage VN of the line node NLN becomes 0V; the voltage VN+1 of the line node NLN+1 maintains at 0V; the voltage VCH3 of the channel node NC3 maintains at the ghost image compensation voltage VP; the voltage VCH2 of the channel node NC2 maintains at the ghost image compensation voltage VP; the current ILED3B flowing through the LED LED3B maintains at 0 A; the current ILED2C flowing through the LED LED2C maintains at 0 A; and the current ILED3C flowing through the LED LED3C also maintains at 0 A.

Figure 3F:
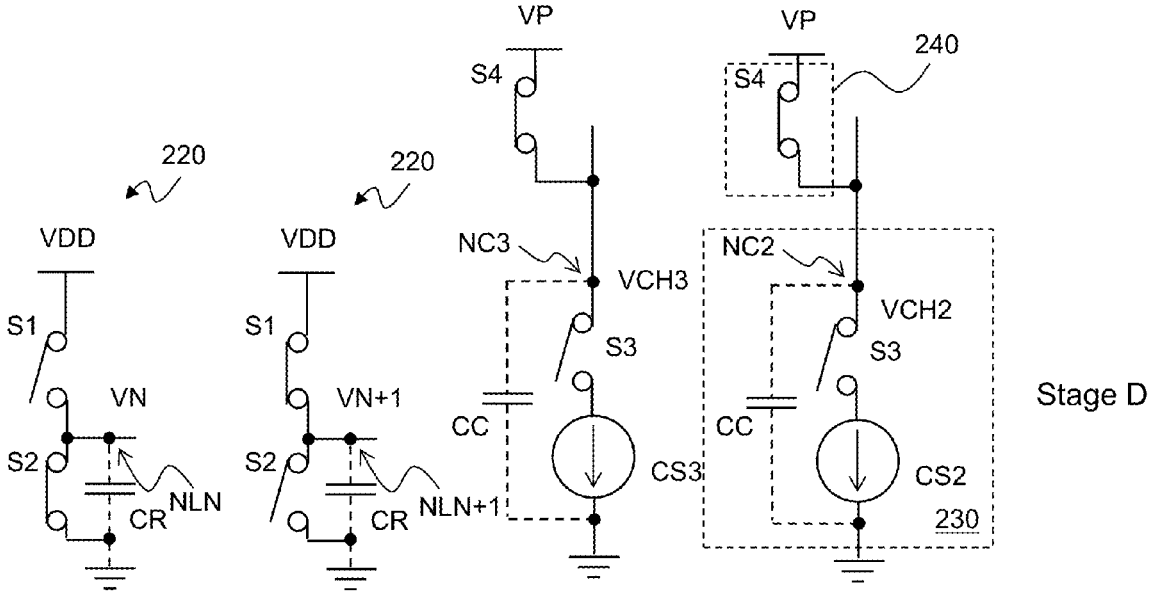

Referring to FIG. 3F, at stage D, the switch S1 in the line switch circuit 220 of the line N is OFF and the switch S2 in the line switch circuit 220 of the line N is ON, while the switch S1 in the line switch circuit 220 of the line N+1 is turned ON and the switch S2 in the line switch circuit 220 of the line N is turned OFF. The switch S3 in the channel switch circuit 230 of the channel CH3 is OFF and the switch S3 in the channel switch circuit 230 of the channel CH2 is OFF. The switch S4 in the ghost image compensation switch circuit 240 of the channel CH3 is ON and the switch S4 in the ghost image compensation switch circuit 240 of the channel CH2 is ON. Therefore, as shown in FIG. 3B, at stage D, the voltage VN of the line node NLN maintains at 0V; the voltage VN+1 of the line node NLN+1 changes from 0V to the conduction voltage VDD; the voltage VCH3 of the channel node NC3 maintains at the ghost image compensation voltage VP; the voltage VCH2 of the channel node NC2 maintains at the ghost image compensation voltage VP; the current ILED3B flowing through the LED LED3B maintains at 0 A; the current ILED2C flowing through the LED LED2C maintains at 0 A; and the current ILED3C flowing through the LED LED3C also maintains at 0 A. Hence, the lower ghost image problem is solved.

Figure 3G:
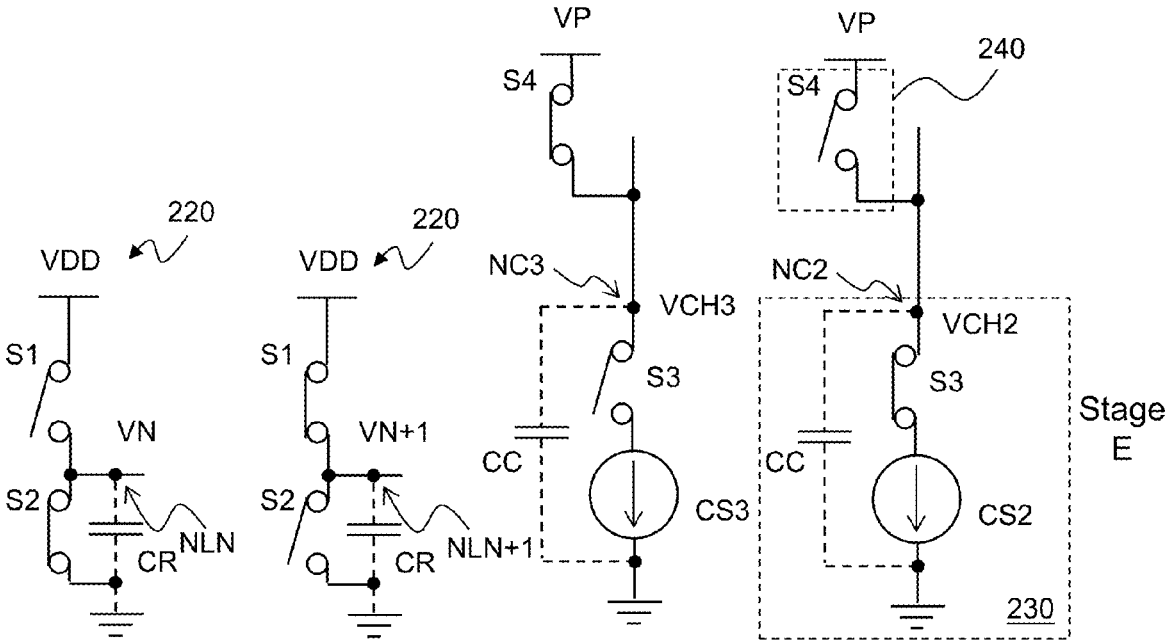

Referring to FIG. 3G, at stage E, the switch S1 in the line switch circuit 220 of the line N is OFF and the switch S2 in the line switch circuit 220 of the line N is ON, while the switch S1 in the line switch circuit 220 of the line N+1 is ON and the switch S2 in the line switch circuit 220 of the line N is OFF. The switch S3 in the channel switch circuit 230 of the channel CH3 is OFF and the switch S3 in the channel switch circuit 230 of the channel CH2 is turned ON. The switch S4 in the ghost image compensation switch circuit 240 of the channel CH3 is ON and the switch S4 in the ghost image compensation switch circuit 240 of the channel CH2 is turned OFF. Therefore, as shown in FIG. 3B, at stage E, the voltage VN of the line node NLN maintains at 0V; the voltage VN+1 of the line node NLN+1 maintains at the conduction voltage VDD; the voltage VCH3 of the channel node NC3 maintains at the ghost image compensation voltage VP; the voltage VCH2 of the channel node NC2 gradually decreases from the ghost image compensation voltage VP to the voltage which is equal to the conduction voltage VDD minus the forward bias voltage VDON of an LED; the current ILED3B flowing through the LED LED3B maintains at 0 A; the current ILED2C flowing through the LED LED2C becomes the current ILED controlled by the current source CS2; the current ILED3C flowing through the LED LED3C maintains at 0 A. However, during the process that the voltage VCH2 of the channel node NC2 gradually decreases, as high-lighted by the dashed circle, the current ILED2C does not immediately reach the level ILED, and therefore the brightness of the LED LED2C is inaccurate, particularly when the brightness is in the low gray scale, which is called "the low gray scale loss". The present invention also solves this low gray scale loss problem.

It should be understood that the dimming control (i.e., brightness adjustment) of the conductive LEDs in the LED array billboard 200 is achieved by controlling the duty period DUTY in the lighting period LEP. For example, referring to stage E in FIG. 3B, the longer the duty period DUTY is in the lighting period LEP, the brighter the LED LED2C will be, whereas the shorter the duty period DUTY is in the lighting period LEP, the less brighter the LED LED2C will be. The LEDs can be of a full brightness when the duty period DUTY is equal to the lighting period LEP. In one embodiment of the present invention as shown in FIG. 3B, the duty period DUTY starts from the beginning of the lighting period LEP; however, the present invention can be embodied in other ways and the duty period DUTY can be located at a later part of the lighting period LEP. (In the embodiment of FIG. 3B, the switch S3 in the channel switch circuit 230 of a selected channel is ON in the duty period DUTY and is turned OFF after the duty period DUTY. The switch S4 in the ghost image compensation switch circuit 240 of the selected channel is not yet turned ON in the lighting period LEP, so the voltage at the channel node, such as shown by the voltage VCH2 at the channel node NC2, will gradually increase. This is acceptable.)

To solve the low gray scale loss problem, according to the present invention, the control circuit 250 adjusts the channel operation signal to add a gray scale compensation period LGC in addition to the duty period DUTY. The gray scale compensation period LGC is added for example after the lighting period LEP as shown in FIG. 3B, or in other embodiments, the gray scale compensation period LGC can be added in or before the lighting period LEP. The switch S3 in the channel switch circuit 230 is turned ON in the gray scale compensation period LGC so that the selected LED (LED2C in the example of FIG. 3B) emits light for an additional period to compensate the low gray scale loss.

Figure 4:
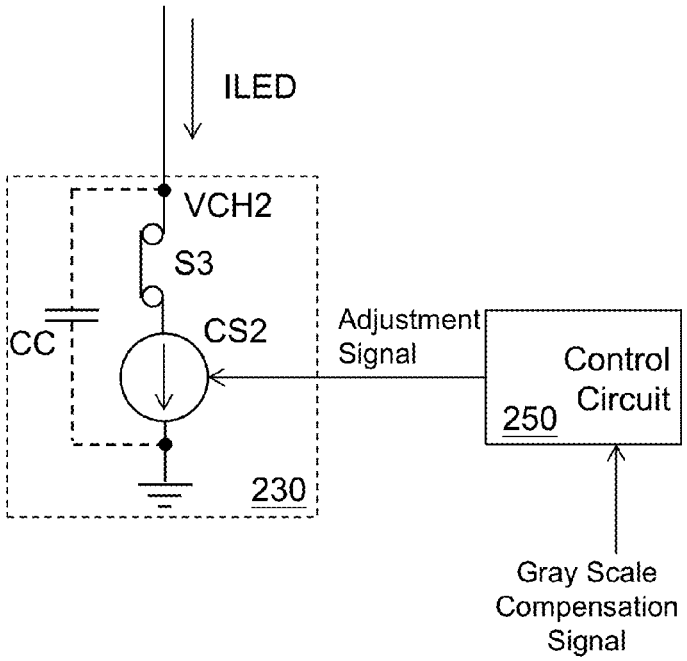
FIG. 4 shows a second embodiment of the present invention.

FIG. 4 shows a second embodiment of the present invention. In addition to solving the ghost image problem and the low gray scale loss problem as in the first embodiment, the second embodiment further adjusts the brightness of the selected LED(s) in the gray scale compensation period LGC. As shown in FIG. 4, the control circuit 250 generates an adjustment signal according to the gray scale compensation signal, to adjust the LED current ILED of the current source (CS2 in this example) so as to adjust the brightness of the selected LED (LED2C in this example) in the gray scale compensation period LGC. In this way, the LED current ILED flowing through the selected LED in the gray scale compensation period LGC can be adjustable according to the degree of the low gray scale loss. In other words, the low gray scale loss can be compensated not only by adjusting the length of the gray scale compensation period LGC, but also by adjusting the LED current ILED flowing through the selected LED, so that the compensation has a higher resolution. In one embodiment, the adjustment signal is for example a digital signal defining a corresponding number of current levels (for example, a 4-bit digital signal defining 16 current levels or a 5-bit digital signal defining 32 current levels). Note that the present invention is not limited to this embodiment; the adjustment signal can be an analog signal, and the number of the bits and the number of the current levels can be changed.

The present invention has been described in considerable detail with reference to certain preferred embodiments thereof. It should be understood that the description is for illustrative purpose, not for limiting the scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, a device which does not substantially influence the primary function of a signal can be inserted between any two devices shown to be in direction connection in the shown embodiments, such as a switch. For another example, the present invention can be applied to any direct current light emitting device, not limited to the LEDs. For another example, the meanings of the high and low levels of a digital signal are interchangeable, with corresponding amendments of the circuits processing these signals. For another example, it is not necessary for each of the lines and channels of the light emitting device array to have the same number of light emitting devices; there can be one or more lines or channels having different numbers of light emitting devices, and there also can be certain light emitting devices not arranged in lines and channels. For another example, a lighting unit shown to be composed of one LED in the embodiments (such as the LED LED1A) can be modified so that one light unit includes more than one LEDs (for example, the LED LED1A is replaced by two LEDs). In view of the foregoing, the spirit of the present invention should cover all such and other modifications and variations, which should be interpreted to fall within the scope of the following claims and their equivalents.

What is claimed is:

1. A light emitting device array billboard, comprising:

a light emitting device array including a plurality of light emitting devices arranged by a plurality of lines and a plurality of channels, wherein in each line, a forward end of each light emitting device is coupled to a common line node, and in each channel, a reverse end of each light emitting device is coupled to a common channel node;

a plurality of line switch circuits respectively coupled to the corresponding line nodes, for electrically connecting the corresponding line nodes to a conduction voltage or a discharge path according to a line operation signal;

a plurality of channel switch circuits each of which includes a corresponding current source, the channel switch circuits being respectively coupled to the corresponding channel nodes, for electrically connecting selected ones of the channel nodes to corresponding current sources according to a channel operation signal;

a plurality of ghost image compensation switch circuits respectively coupled to the corresponding channel nodes, for electrically connecting selected ones of the channel nodes to a ghost image compensation voltage according to a ghost image compensation signal; and a control circuit coupled to the line switch circuits, the channel switch circuits and the ghost image compensation switch circuits, for providing the line operation signal, the channel operation signal and the ghost image compensation signal;

wherein the control circuit provides the line operation signal and the channel operation signal to respectively control the line switch circuits and the channel switch circuits such that a selected one of the light emitting devices is turned ON for a duty period within a lighting period, and the control circuit provides the ghost image compensation signal to control the ghost image compensation switch circuits such that the channel node corresponding to the selected one of the light emitting devices is electrically connected to the ghost image compensation voltage when the selected one of the light emitting devices is not conductive after the lighting period; and wherein the control circuit further adjusts the channel operation signal according to a gray scale compensation signal such that the selected one of the light emitting devices is turned ON for a gray scale compensation period in addition to the duty period.

2. The light emitting device array billboard according to claim 1, wherein each of the line switch circuits includes:

a first switch coupled to the corresponding line node, for electrically connecting the corresponding line node to the conduction voltage according to the line operation signal; and a second switch coupled to the corresponding line node, for electrically connecting the corresponding line node to ground or a relatively lower potential according to the line operation signal, for providing the discharge path.

3. The light emitting device array billboard according to claim 1, wherein each of the channel switch circuits includes:

a third switch coupled to the corresponding channel node, for electrically connecting the corresponding channel node to the current source according to the channel operation signal; and the current source, coupled to the third switch, for providing a light emitting device current to the selected one of the light emitting devices.

4. The light emitting device array billboard according to claim 3, wherein the control circuit further provides an adjustment signal according to the gray scale compensation signal to adjust the light emitting device current in the gray scale compensation period.

5. The light emitting device array billboard according to claim 1, wherein the ghost image compensation voltage is higher than a voltage which is equal to the conduction voltage minus a forward bias voltage of the light emitting device.

6. The light emitting device array billboard according to claim 1, wherein the control circuit further adjusts the channel operation signal according to the gray scale compensation signal such that the non-selected light emitting devices are not turned ON in the lighting period and the gray scale compensation period.

7. A method for controlling a light emitting device array billboard which includes a plurality of light emitting devices arranged by a plurality of lines and a plurality of channels, wherein in each line, a forward end of each light emitting device is coupled to a common line node, and in each channel, a reverse end of each light emitting device is coupled to a common channel node, the method comprising:

selecting at least one of the light emitting devices;

electrically connecting the line node corresponding to the selected one of the light emitting devices to a conduction voltage or a discharge path according to a line operation signal;

electrically connecting the channel node corresponding to the selected one of the light emitting devices to a current source according to a channel operation signal;

electrically connecting the channel node corresponding to the selected one of the light emitting devices to a ghost image compensation voltage according to a ghost image compensation signal, whereby the selected one of the light emitting devices is turned ON for a duty period within a lighting period according to the line operation signal and the channel operation signal, and the channel node corresponding to the selected one of the light emitting devices is electrically connected to the ghost image compensation voltage according to the ghost image compensation signal after the lighting period; and adjusting the channel operation signal according to a gray scale compensation signal such that the selected one of the light emitting devices is turned ON for a gray scale compensation period in addition to the duty period.

8. The method for controlling a light emitting device array billboard according to claim 7, wherein the ghost image compensation voltage is higher than a voltage which is equal to the conduction voltage minus a forward bias voltage of the light emitting device.

9. The method for controlling a light emitting device array billboard according to claim 7, further comprising: providing an adjustment signal according to the gray scale compensation signal to adjust a current of the selected one of the light emitting devices in the gray scale compensation period.

10. The method for controlling a light emitting device array billboard according to claim 7, wherein the non-selected light emitting devices are not turned ON in the lighting period and the gray scale compensation period.

* * * * *